US011072940B2

(12) United States Patent
Benton et al.

(10) Patent No.: US 11,072,940 B2
(45) Date of Patent: Jul. 27, 2021

(54) EMBEDDED POST BASE

(71) Applicants: James M. Benton, Discovery Bay, CA (US); Emmet J. Mielbrecht, Danville, CA (US)

(72) Inventors: James M. Benton, Discovery Bay, CA (US); Emmet J. Mielbrecht, Danville, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

(21) Appl. No.: 16/256,938

(22) Filed: Jan. 24, 2019

(65) Prior Publication Data

US 2019/0284828 A1 Sep. 19, 2019

Related U.S. Application Data

(60) Provisional application No. 62/622,073, filed on Jan. 25, 2018.

(51) Int. Cl.
*E04H 12/22* (2006.01)

(52) U.S. Cl.
CPC ..... *E04H 12/2269* (2013.01); *E04H 12/2215* (2013.01)

(58) Field of Classification Search
CPC ..... E04H 12/2269; E04H 12/2215; E04H 12/2261; E04H 12/2292; E04H 12/227; E04H 12/22; E04H 12/2253; E04H 17/22; E02D 27/42; E02D 27/43
USPC ..... 52/169.13, 170, 295–298, 712
See application file for complete search history.

(56) References Cited

U.S. PATENT DOCUMENTS

| | | | | | |
|---|---|---|---|---|---|
| 76,515 | A | * | 4/1868 | Patton | E04H 12/2269 52/298 |
| 284,219 | A | | 9/1883 | Mehew | |
| 589,079 | A | * | 8/1897 | Glazier | E04H 12/2215 52/165 |
| 844,726 | A | * | 2/1907 | Hunter | A01C 5/02 111/99 |
| 887,217 | A | * | 5/1908 | Oliphant | 52/295 |
| D215,727 | S | * | 10/1969 | Gilb | D8/373 |
| 3,750,360 | A | | 8/1973 | Kingston | |
| 4,096,677 | A | * | 6/1978 | Gilb | E02D 27/42 405/231 |
| D254,476 | S | * | 3/1980 | Gilb | D8/349 |

(Continued)

FOREIGN PATENT DOCUMENTS

| | | |
|---|---|---|
| DE | 27232 | 5/1884 |
| GB | 2232172 A | 12/1990 |

(Continued)

OTHER PUBLICATIONS

Simpson Strong-Tie Company, Inc., Simpson Strong-Tie Connectors Catalog C-2003, 2003, pp. 36-39, C-2003, Simpson Strong-Tie Company, Inc., USA.

*Primary Examiner* — Brian E Glessner
*Assistant Examiner* — Adam G Barlow
(74) *Attorney, Agent, or Firm* — James R. Cypher; Charles R. Cypher

(57) ABSTRACT

A connector is constructed so as to be embedded in a cementitious member and connect a post or other supported member to the cementitious member, such that the connection formed can resist rotational and bending moment forces transmitted to the connector by the post that it supports.

20 Claims, 19 Drawing Sheets

(56) References Cited

U.S. PATENT DOCUMENTS 4,199,908 A * 4/1980 Teeters ..... E04H 12/2284 248/357
D260,964 S 9/1981 Gilb
4,516,365 A 5/1985 Chapman
4,543,757 A * 10/1985 Cosgrove ..... E02D 27/42 248/158
4,644,713 A * 2/1987 Lehman ..... E04H 12/2215 52/165
4,924,648 A * 5/1990 Gilb ..... E04B 1/41 52/295
4,958,470 A 9/1990 Han et al.
4,995,206 A * 2/1991 Colonias ..... E04H 12/2253 52/298
5,203,817 A * 4/1993 Klumpjan ..... E04H 12/2276 256/19
5,307,603 A 5/1994 Chiodo
5,333,435 A 8/1994 Leek
5,456,441 A 10/1995 Callies
5,575,130 A * 11/1996 Chiodo ..... E04B 1/41 52/295
5,666,774 A 9/1997 Commins
6,401,411 B1 6/2002 Maglio, Jr.
6,513,290 B2 2/2003 Leek
6,840,020 B2 1/2005 Leek
6,886,296 B1 * 5/2005 John ..... E02D 5/60 248/519
6,964,139 B2 11/2005 Meyer et al.
7,152,841 B2 12/2006 Callies
7,296,386 B2 * 11/2007 Leek ..... E04B 1/24 52/296
7,461,493 B2 12/2008 Querlelet
7,627,995 B1 * 12/2009 Yoder ..... E04H 12/2253 248/519
D610,717 S 2/2010 Lin
7,980,034 B2 7/2011 Fehr et al.
8,082,702 B2 12/2011 Hill
8,347,571 B2 1/2013 Fehr et al.
8,572,905 B1 11/2013 Driggers
8,584,413 B1 * 11/2013 Keller, Sr. ..... E02D 27/32 52/297
8,713,872 B2 5/2014 Rempel
8,864,096 B1 * 10/2014 Fox ..... E04H 12/2292 248/534
8,959,857 B1 * 2/2015 Lin ..... E04H 12/2261 256/65.14
9,347,196 B2 5/2016 Wagler
2006/0239764 A1 * 10/2006 Salman ..... E04B 1/4114 403/2
2014/0373461 A1 12/2014 Rodriguez

FOREIGN PATENT DOCUMENTS

GB 2275337 A 9/1994
GB 2352256 A 1/2001

* cited by examiner

EMBEDDED POST BASE

BACKGROUND OF THE INVENTION

The present invention provides a connection between a cementitious foundation and an upstanding vertical member or post by means of a partially embedded connector and fasteners. The connector anchors the post to the foundation to counteract moment and uplift forces on the post while also supporting the bottom of the post and transferring bearing forces into the foundation.

Early connectors for anchoring posts to a foundation were U-shaped metal straps that were set in the wet concrete. The post was fastened to the upstanding metal straps that extended above the concrete. Later it was discovered that it is best to not have the post bear directly on the concrete foundation. If the post is made from wood, the end of the post can absorb moisture from water on the foundation surface. One solution to this problem was to connect an intermediate plate to the upstanding straps above the level of the concrete and have the post bear on this intermediate plate. U.S. Design Pat. No. D215,727, invented by Tyrell Gilb and which issued in 1969 shows such a post connector. Another solution to this problem is taught in U.S. Pat. No. 4,543,757 which was invented by Eunice M. Cosgrove and which issued on Oct. 1, 1985. According to this patent, the post can be supported by tabs struck from the metal sides of the connector.

Another early unpatented solution for connecting a post to a foundation was to anchor an upstanding tubular or rod-like member in the foundation that protrudes above the surface. The tubular anchor was provided with a u-shaped or tray-shaped member at its top that could receive and support the post. The sides of the members atop the tubular anchor would be connected to the sides of the post. One of the earlier patents to this type of anchor is U.S. Pat. No. 2,909,816, invented by Wood and which granted in 1959.

These early connectors were sufficient if the moment forces on the post were not too large. Posts that are laterally braced may exert very small moment forces on their embedded supports and the foundation. The moment forces experienced by a connector or support depend on the overall design of the structure. For example, the typical fence post is laterally braced along the length of the fence but can experience high moment forces from winds loads on the fence perpendicular to the fence sheathing.

Additional patents in this area, include U.S. Pat. No. 4,995,206, invented by Karen W. Colonias et al and which issued on Feb. 26, 1991. This patent teaches a connector for a post that is shaped similarly to a bolt which supports a tray-shaped top for receiving the post, but the connector is made from a single sheet metal blank that is folded on itself. U.S. Pat. No. 4,096,677, invented by Tyrell Gilb and which issued on Jun. 27, 1978, teaches an embedded post connector where the main body of the connector is created by bending an elongated member upon itself. The post is attached to the connector with bolts that are run through the two ends of the straps protruding from the foundation. The connector is used with a stand-off member that attaches to the two upstanding straps. United Kingdom Patent 2,274,937, invented by Martin Olsen and which published on Sep. 14, 1994, teaches a two-part connector where each part consists of an elongated strap that has a lower portion that is embedded in the ground and an upper portion that interfaces with the post, and each part also has an intermediary plate that juts from the strap and is disposed underneath the post. The elongated straps are connected to each other through fasteners received in the jutting intermediary plates below the post. U.S. Pat. No. 6,886,296, invented by Michael John and which issued on May 3, 2005, teaches a box-shaped protective sleeve that attaches to the base of a post by means of screws. The sleeve and the base of the post are inserted in the ground. The box-shaped sleeve completely encloses the base of the post except for the fastener openings that attach the post to the connector. According to the invention, openings are provided in the base of the box-shaped protective sleeve to allow moisture to drain from the bottom of the sleeve.

The present invention improves upon the prior art by providing a connector that is inexpensive to make and install and yet provides strong resistance to moment forces imposed on the post.

SUMMARY OF THE INVENTION

It is an object of the present invention to provide an embedded connector that can be constructed from a single sheet metal blank, requires no welding or painting, and can resist rotational and bending moment forces transmitted to the connector by the post that it supports.

It is a further object of the present invention to provide a connector that can elevate the bottom of the post above the top surface of the foundation or cementitious member.

It is further object of the invention to provide a support that has two upstanding front and back members that have overlapping portions that envelope the post where it is received by the connector. The connector is connected to the post by fastener. The fasteners are preferably threaded fasteners when the post is made from wood.

It is a further object of the invention to provide the overlapping portions with formations to hold the overlapping parts in relation to each other. In one embodiment, the formations are matching tabs and openings that receive the tabs. In another embodiment, the formations are deformations in the form of a depression in one flange and a deformation in the form of a matching projection in the other that is received in the depression.

It is a further object of the invention to provide the embedded portion of the connector with wedging portions in the form of embossments or protrusions to resist uplift. Preferably this wedging portion is formed as one large protrusion that extends a substantial portion of the width of the connector. The wedging portion or protrusion can be formed with one or more openings. The openings are preferably formed in the upper portion of the protrusion.

It is a further object of the invention to provide fasteners that extend through overlapping portions of the front and back members and into the supported member or post.

It is a further object of the invention to provide portions of the front and back members with offsets so that the front and back members can overlap while still closely engaging the sides of the post.

It is a further object of the invention to provide generally vertically disposed embossments in the front and back members below the level of the concrete such that the embossments have portions that are embedded in the cementitious members. The embossed portions of the front and back members preferably extend outwardly from the connector.

It is a further object of the invention to provide tabs or seats that support the post above the top surface of the foundation. Further, one or more openings are provided in the connector that are disposed just above the upper surface of the cementitious member.

It is a further object of the invention to provide a connector with a base member that has a front edge and an opposed back edge with the front member being connected to the front edge of the base member and the opposed back member being connected to the back edge of the base member.

It is a further object of the invention to provide a connector with one or more side flanges extending angularly toward the other of the opposed front and back members and overlapping with portions of the other of the front and back member, the side flanges overlap along most the length of the portion of the post that is received in the connector.

It is a further object of the invention to provide a connector with one or more tabs that are formed from the front and back members that align with the upper surface of the cementitious member, and the front and back members are provided with one or more openings that are disposed just above the tabs that align with the upper surface of the cementitious member.

It is a further object of the invention to provide a connector where the post rests on one or more seats and the one or more seats are formed from the front and back members of the connector.

It is a further object of the present invention to provide a connector where the one or more side flanges of the front and back members are integrally attached to the front and back members throughout a substantial portion of their length.

It is a further object of the present invention to provide a connector where the one or more side flanges of the front and back members are formed with outer edges that have alternating projecting portions and notches where the overlap with the other of the front and back member occurs and the notches in one of the front and back members correspond with the projecting portions in the other of the front and back members.

BRIEF DESCRIPTION OF THE DRAWINGS

FIG. 4 is front view of the connector of FIG. 3. The back view is similar.

FIG. 5 is a right side view of the connector of FIG. 3. The left side view is similar.

FIG. 14 is a front view of the connector of FIG. 13. The back view is similar.

FIG. 15 is a right side view of the connector of FIG. 13. The left side view is similar.

FIG. 21 is a right side view of the connector shown in FIG. 20. The left side view is similar.

DETAILED DESCRIPTION OF THE INVENTION

Figure 10:
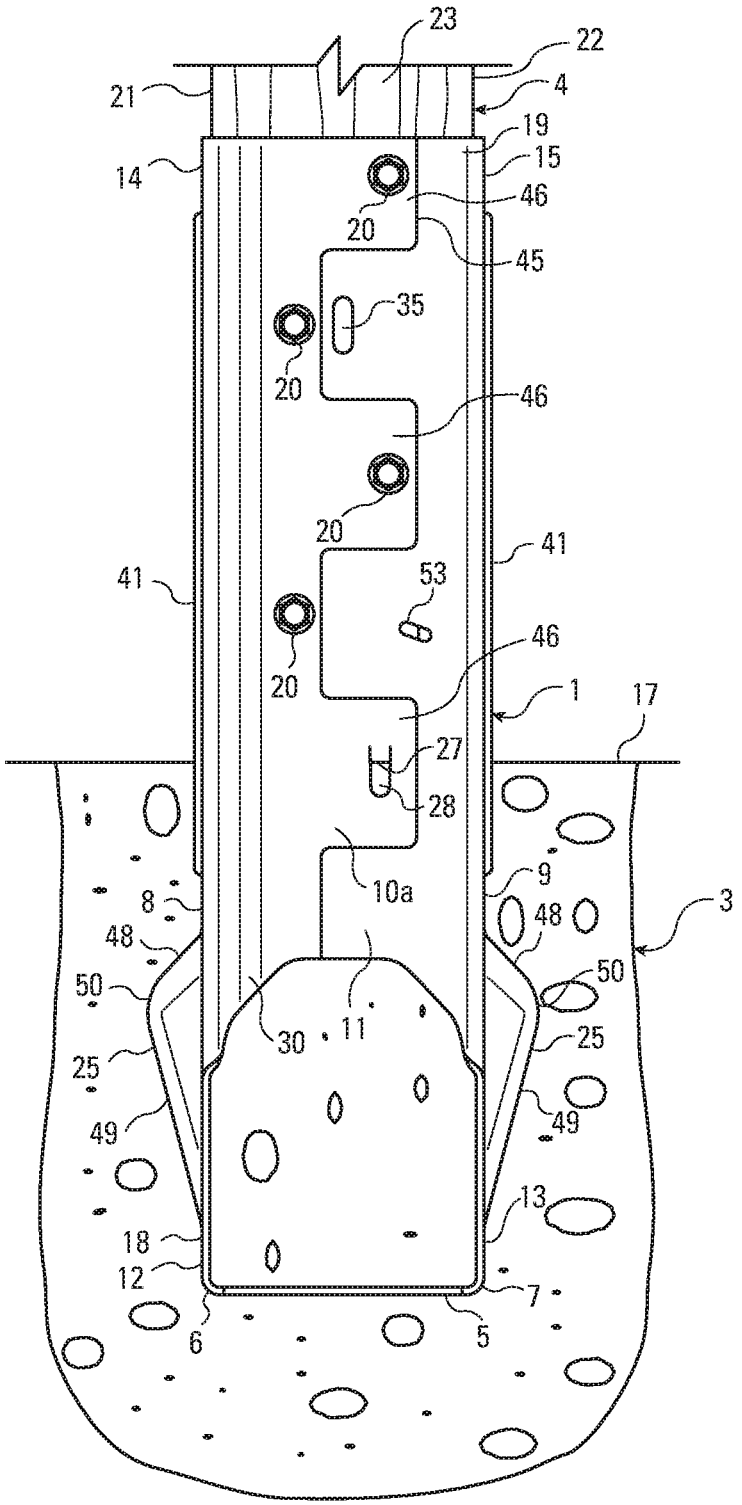
FIG. 10 is a right side view of the connection of the present invention, showing the connector embedded in a cementitious member.

As shown in FIG. 10, according to the present invention, the connector 1 is embedded in and supported by a cementitious member 3 such as a concrete base or foundation. The connector 1 receives a post or supported member 4. The preferred elevated post base or connector 1 of the present invention is formed from a sheet metal blank and consists of one member having portions folded on itself.

Figure 1:
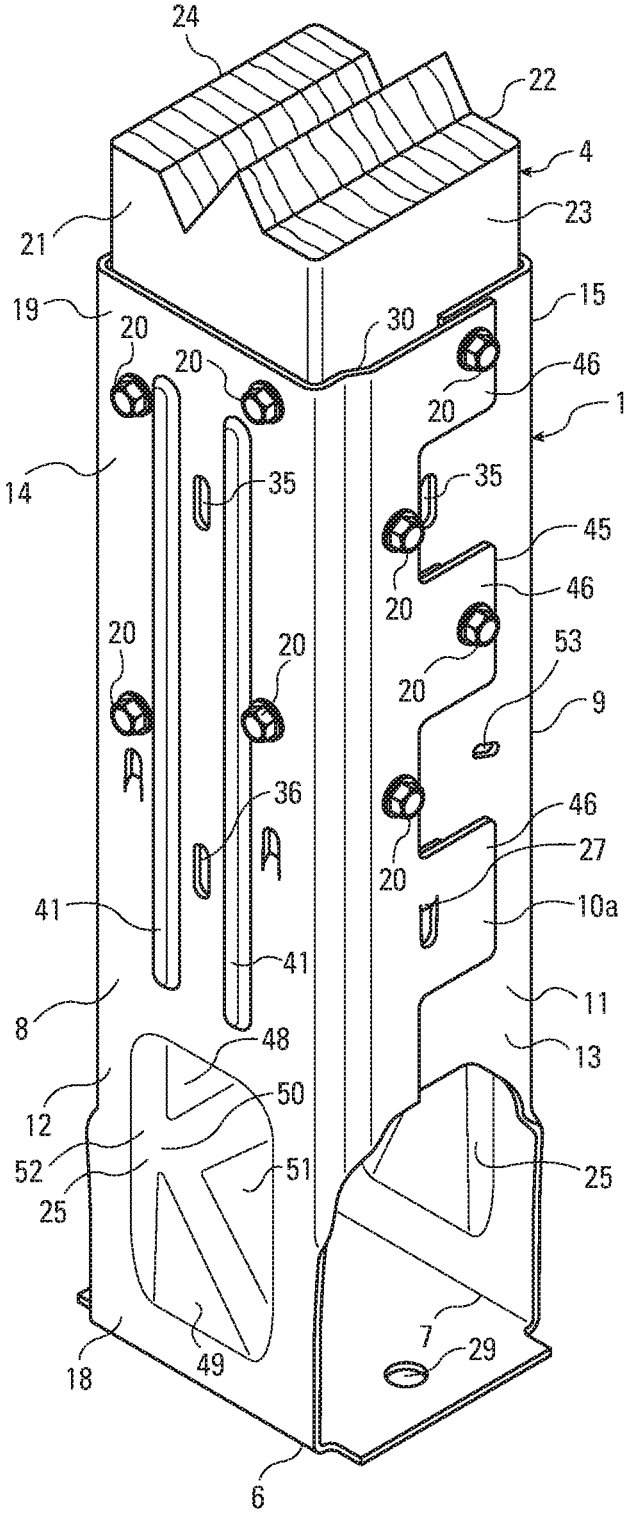
FIG. 1 is a perspective view of a connector, fasteners and post of the present invention.

As shown in FIG. 1, the connector 1 consists of a base or foot member 5 adapted for embedment in the cementitious member 3. The base member 5 is formed with opposed front and back edges 6 and 7.

Figure 2:
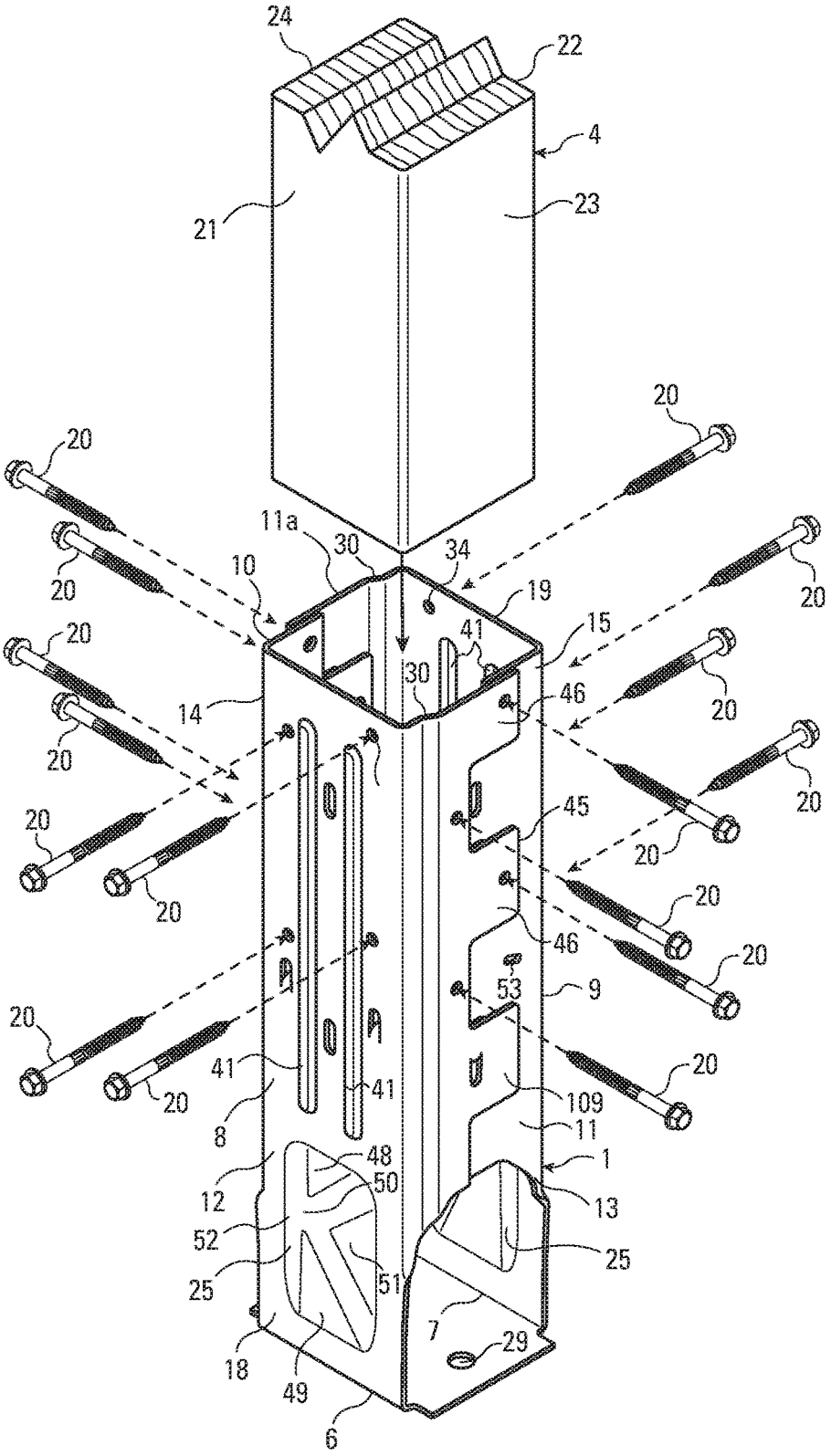
FIG. 2 is an exploded perspective view of the connector, fasteners and post of the present invention.

As shown in FIG. 2, attached to the front and back edges 6 and 7 and extending upwardly therefrom are front and back members 8 and 9, respectively. Preferably, the front and back members 8 and 9 are each formed with a respective first side flange 10 or 11. The front and back members 8 and 9 each have lower ends 12 and 13 which are integrally connected to the opposed font and back edges 6 and 7 of the base member 5 and adapted for embedment in the concrete foundation 3. The front and back members 8 and 9 have upper portions 14 and 15 that extend above the cementitious member 3. The upper portions 14 and 15 substantially extend along the supported member 4. The post or supported member 4 has a bottom surface 16 and the cementitious member 3 has an upper or top surface 17 with the bottom surface 16 of the post 4 preferably being spaced apart from the base member 5 and with material of the cementitious member 3 disposed between the bottom surface 16 of the post 4 and the base member 5. The bottom surface 16 of the post 4 is also preferably supported by the connector 1 above the upper surface 17 of the cementitious member 3. The connector 1 has a lower portion 18 embedded in the cementitious member 3 and an upper portion 19 receiving the post 4 with cementitious material from the cementitious member 3 disposed within the lower portion 18 of the connector 1.

Figure 3:
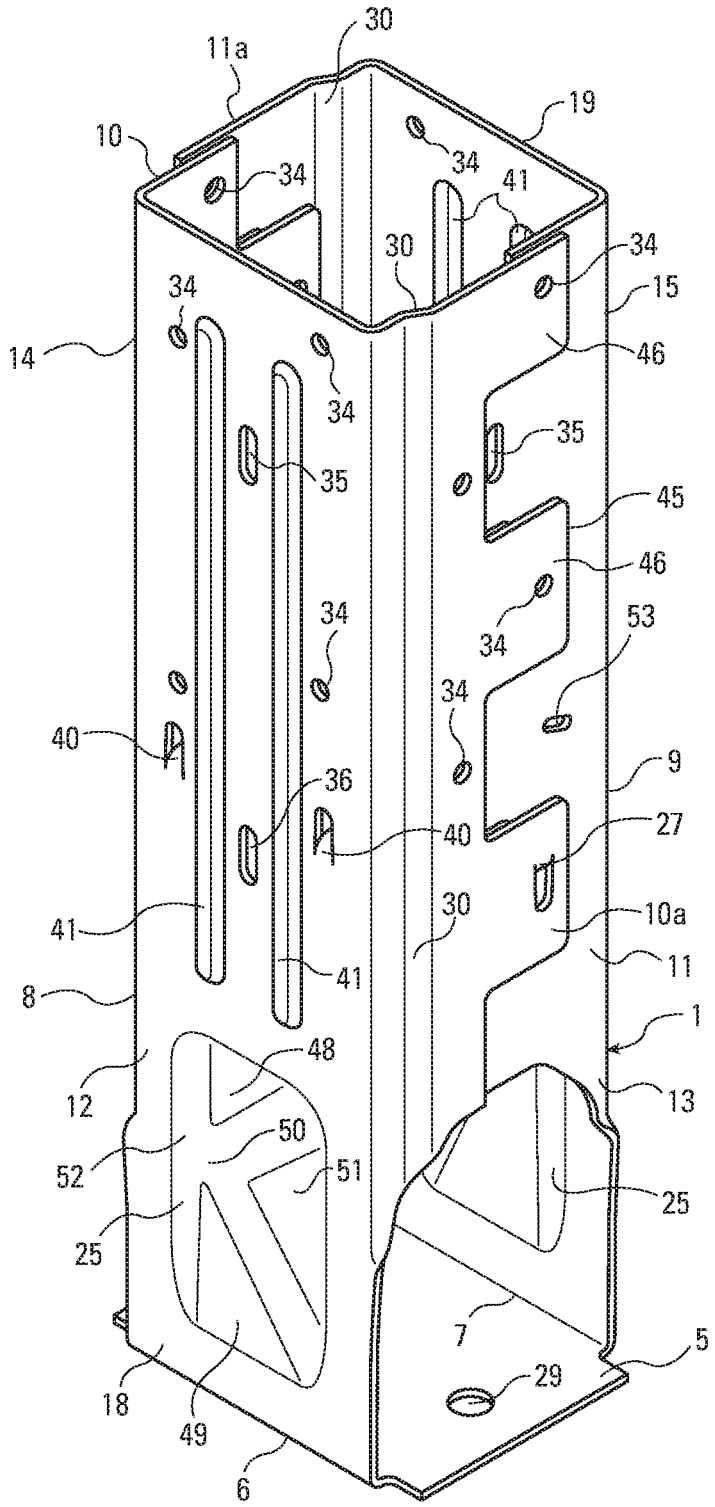
FIG. 3 is a perspective view of a connector of the present invention.
Figure 11:
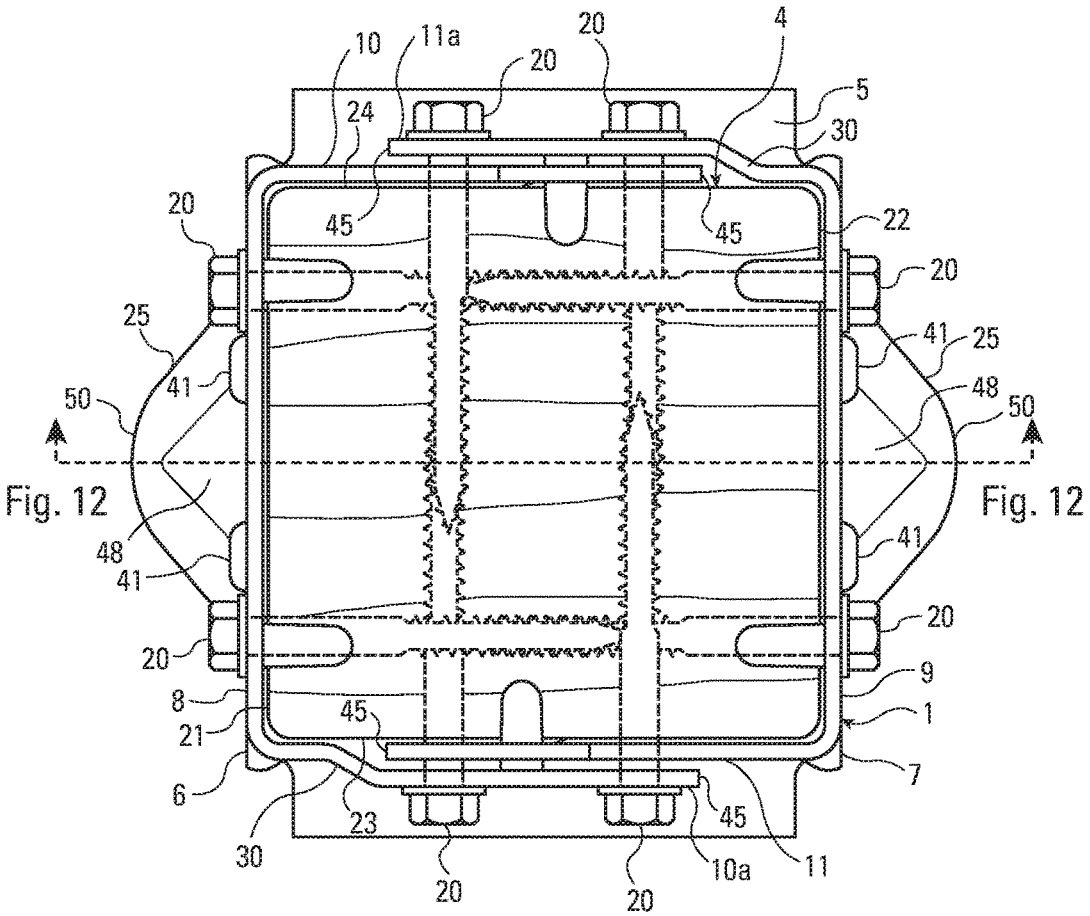
FIG. 11 is a top view of a connector, post and fasteners of the present invention. The embedded portions of the fasteners are shown in dotted lines.

As shown in FIGS. 3, 10 and 11, the front member 8 is connected to the front edge 6 of the base member 5. The front member 8 extends upwardly from the base member 5 so as to extend out of the upper surface 17 of the cementitious member 3. The front member 8 has one or more side flanges, preferably a first side flange 10 and a second side flange **10*a* extending angularly toward the opposed back member 9 and overlapping with portions of the back member 9 where the connector 1 receives the post 4. Similarly, the opposed back member 9 is connected to the back edge 7 of the base member 5. The opposed back member 9 extends upwardly from the base member 5 so as to extend out of the upper surface 17 of the cementitious member 3. The back member 9 has one or more side flanges, preferably a first side flange 11 and a second side flange 11***a* extending angularly toward the opposed front member 8 and overlapping with portions of the front member 8 where the connector 1 receives the post 4 such that together the front member 8 and the back member 9 encapsulate or surround a basal portion of the post 4. Preferably the front and back members 8 and 9 and the side flanges 10, 10*a*, 11 and 11*a* closely received the post 4.

As shown in the FIGS. 1, 10 and 11, one or more fasteners 20 connect the post 4 to the connector 1 so that the post 4, the connector 1 and the cementitious member 3 will resist movement as a unit. The fasteners 20 are preferably self-drilling and self-tapping threaded fasteners that are driven through the connector 1 and into the supported member 4.

The front and back members 8 and 9 are attached to at least two opposed sides 21 and 22 of the supported member or post 4 with fasteners 20, and preferably the front and back members 8 and 9 are attached to the other two opposed sides 23 and 24 of a four-sided post or supported member 4. As shown in FIG. 10, opposed sides 21 and 22 of the post 4 are aligned with the front and back edges 6 and 7 of the base member 5.

Figure 6:
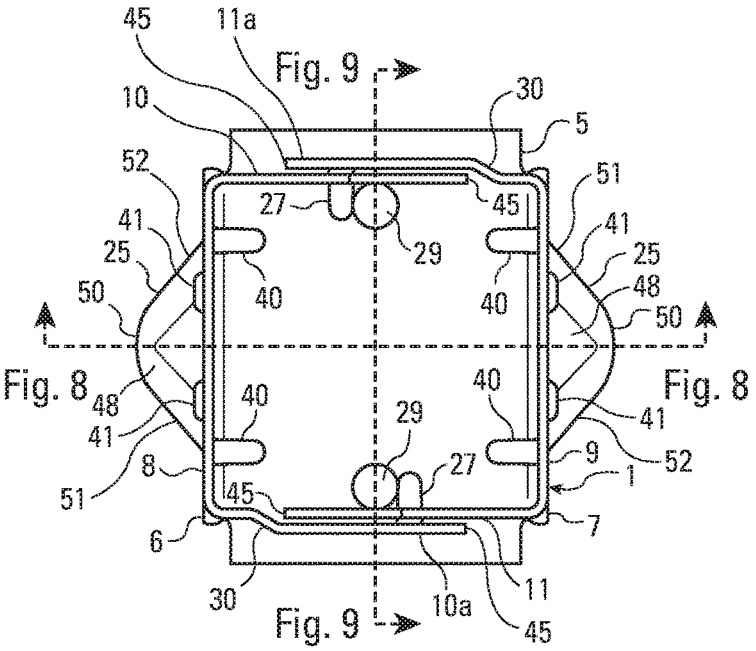
FIG. 6 is a top view of the connector of FIG. 3.

As shown in FIGS. 1 and 6, the connector 1 is preferably formed so that lateral ends of the foot member 5 extend laterally beyond the first side flanges 10 and 11 of the front and back members 8 and 9.

Figure 5:
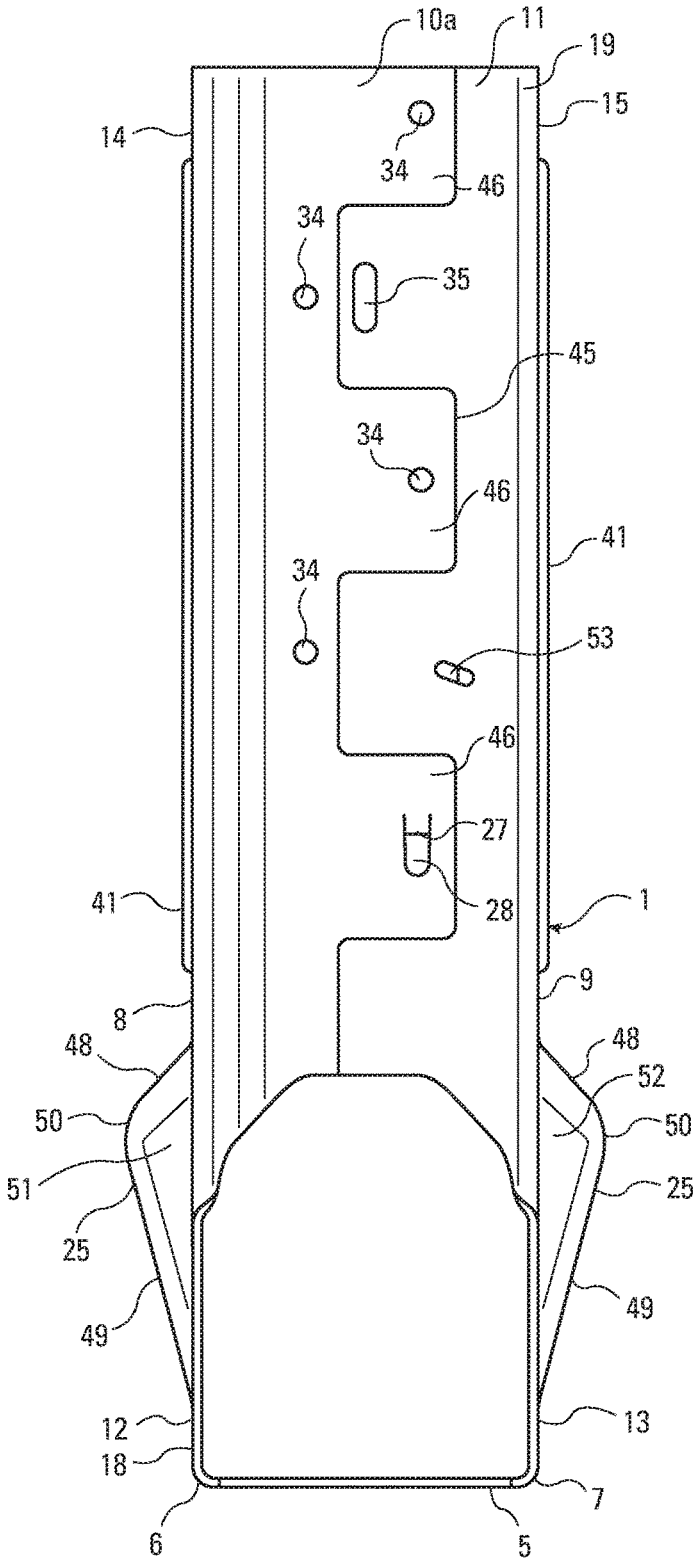
Figure 20:
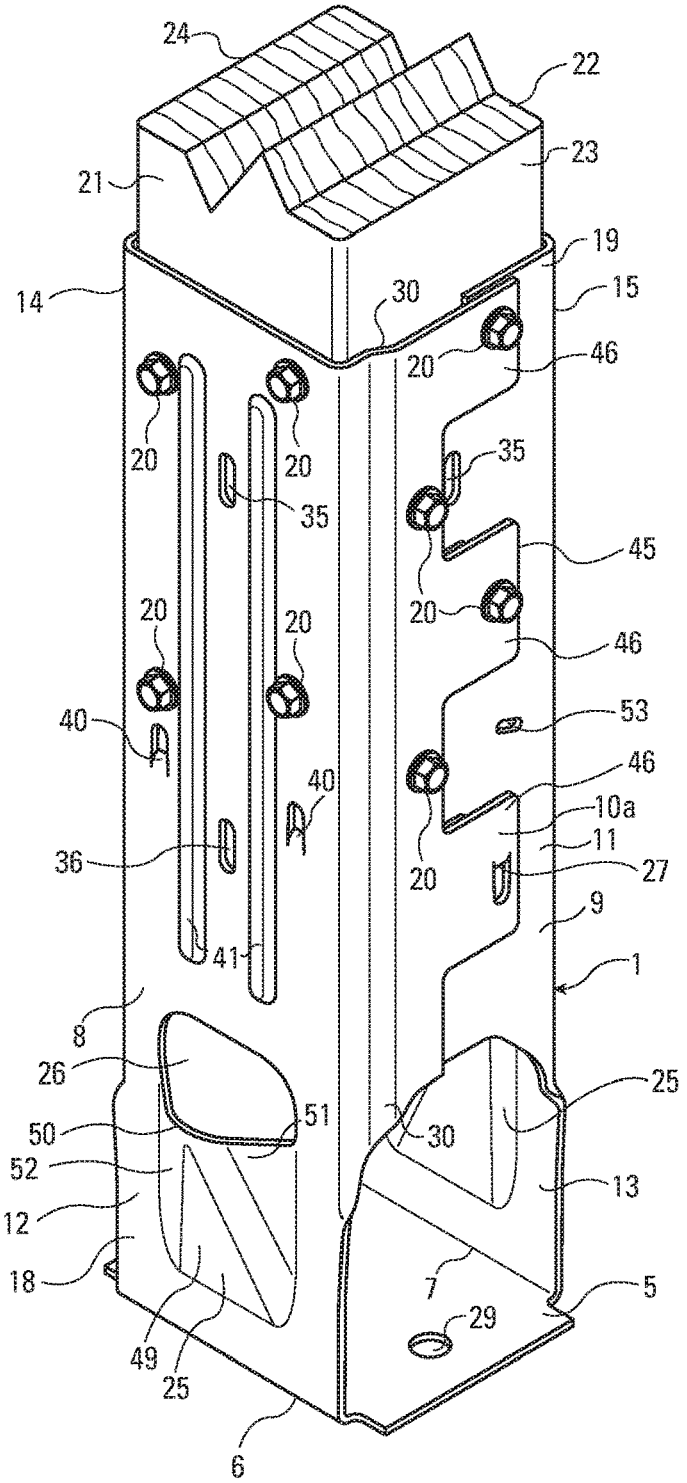
FIG. 20 is a perspective view of a connector, post and fasteners of the present invention.
Figure 21:
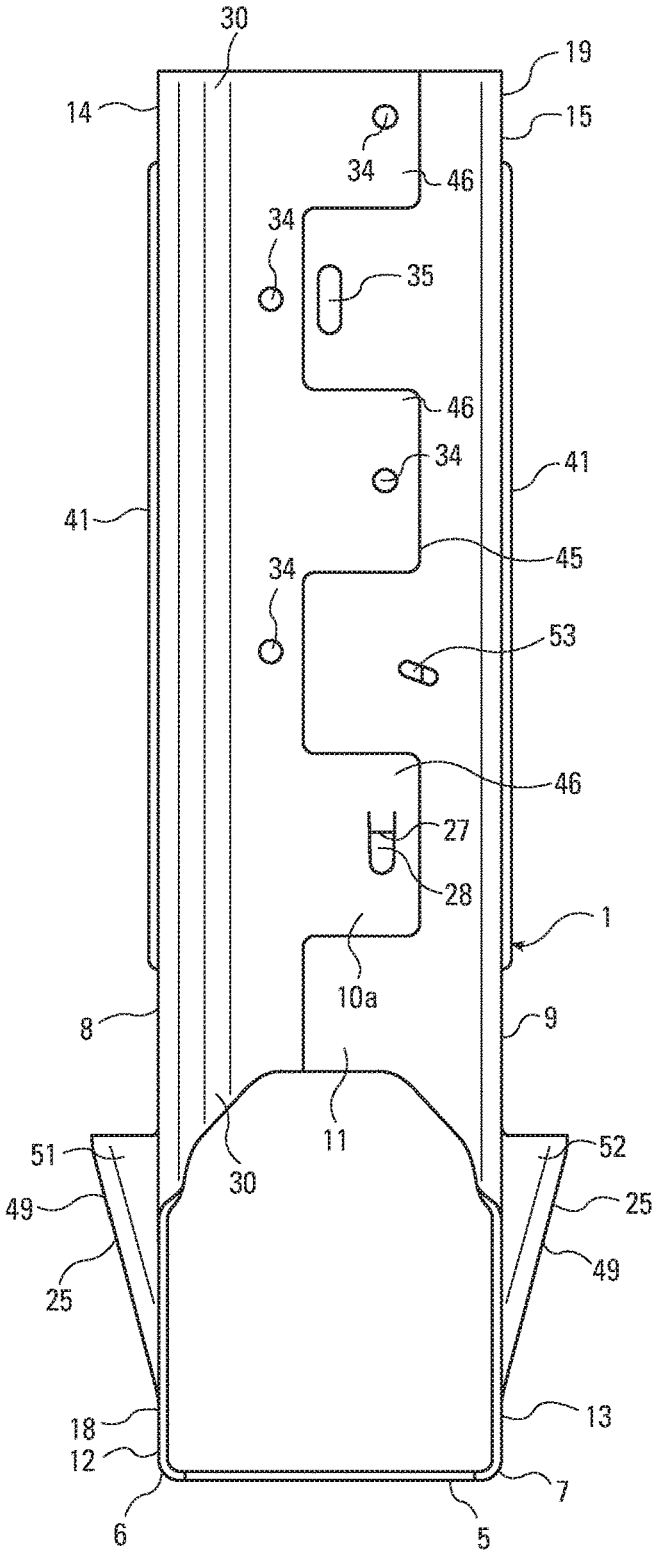

As shown in FIGS. 1 and 5, the lower portions of the front and back members 8 and 9 are formed with protrusions 25 that extend outwardly from the front and back members 8 and 9 and away from the connector 1. The protrusions 25 form wedges that interlock with the concrete or cementitious base 3 to better resist uplift. As shown in FIGS. 20 and 21, one or more openings 26 can be provided in the protrusions 26. As shown in FIGS. 20 and 21, the opening 26 is preferably formed in upper portion of the protrusion 26 and one large opening is provided to increase concrete flow into the connector 1.

Figure 8:
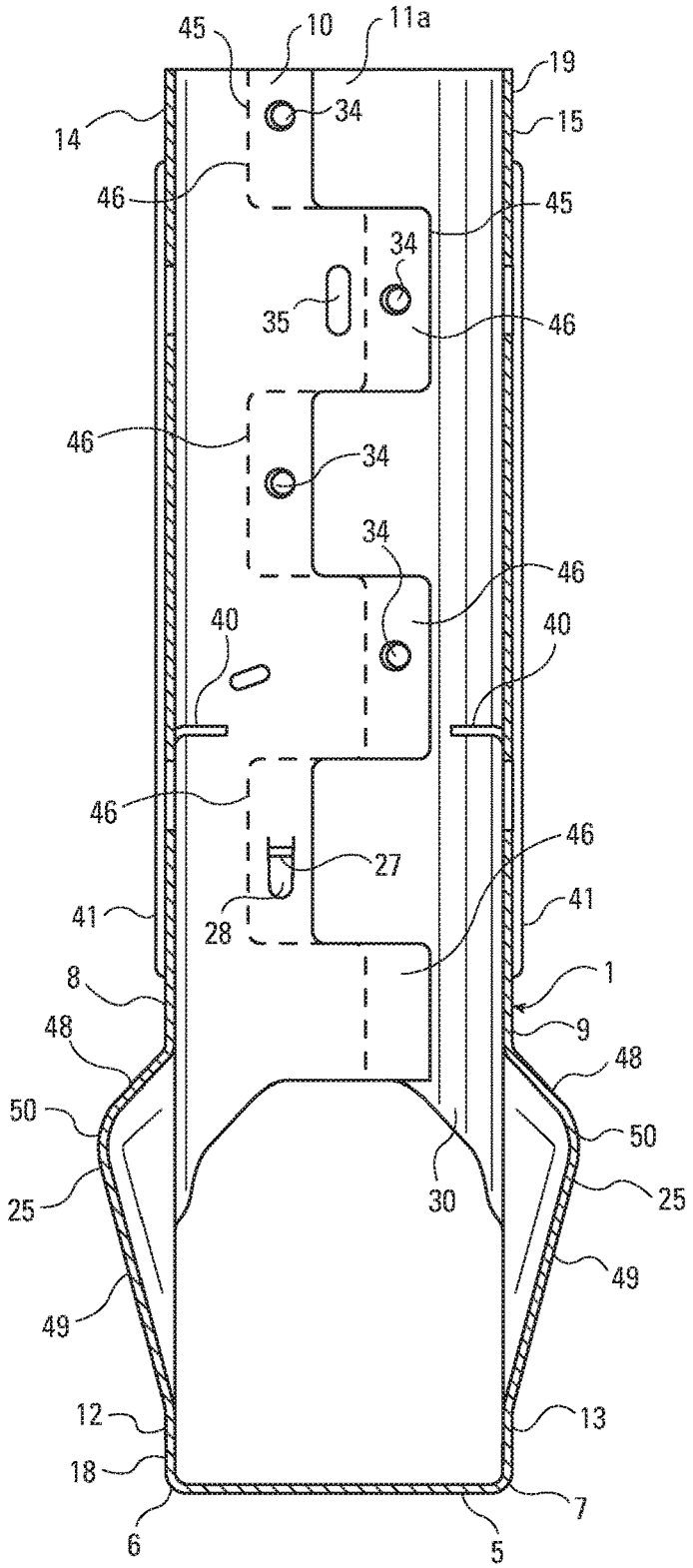
FIG. 8 is a cross-sectional side view of the connector of FIG. 3 taken along the view line shown in FIG. 6.

Although the embedment of the elevated post base 1 in the cured foundation 3 would hold the front and back members 8 and 9 in place, preferably the front and back members 8 and 9 are formed to interlock with each other where they overlap to hold the front and back members 8 and 9 in place while the wet concrete cures. As shown in FIGS. 6 and 8, each of the front and back members 8 and 9 is formed with a bent tab 27 that interlocks with a corresponding opening 28 on the opposed front or back member 8 or 9 to hold the front and back members 8 and 9 in fixed relation to one another. Another way to form a mechanical interlock between the side flanges 10, 10*a*, 11 and 11*a* of the front and back members 8 and 9 would be to form projecting portions in the front and back members 8 and 9 that interlocks with depressions formed in the corresponding front or back members 8 and 9. Front and back members 8 and 9 could also be held together by placing a pop rivet through openings in the front and back members 8 and 9. The front and back members 8 and 9 could also be welded together, but preferably some type of mechanical locking mechanism built into the front and back members 8 and 9 is preferred.

Figure 7:
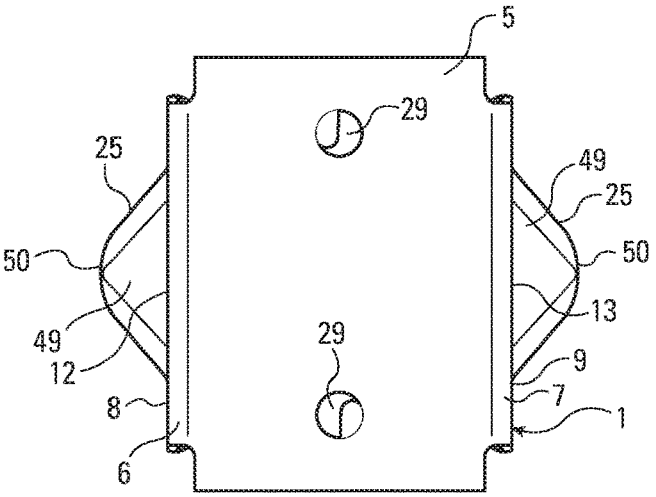
FIG. 7 is a bottom view of the connector of FIG. 3.

As shown in FIGS. 1, 6 and 7, preferably openings 29 may be formed in base member 5.

Figure 9:
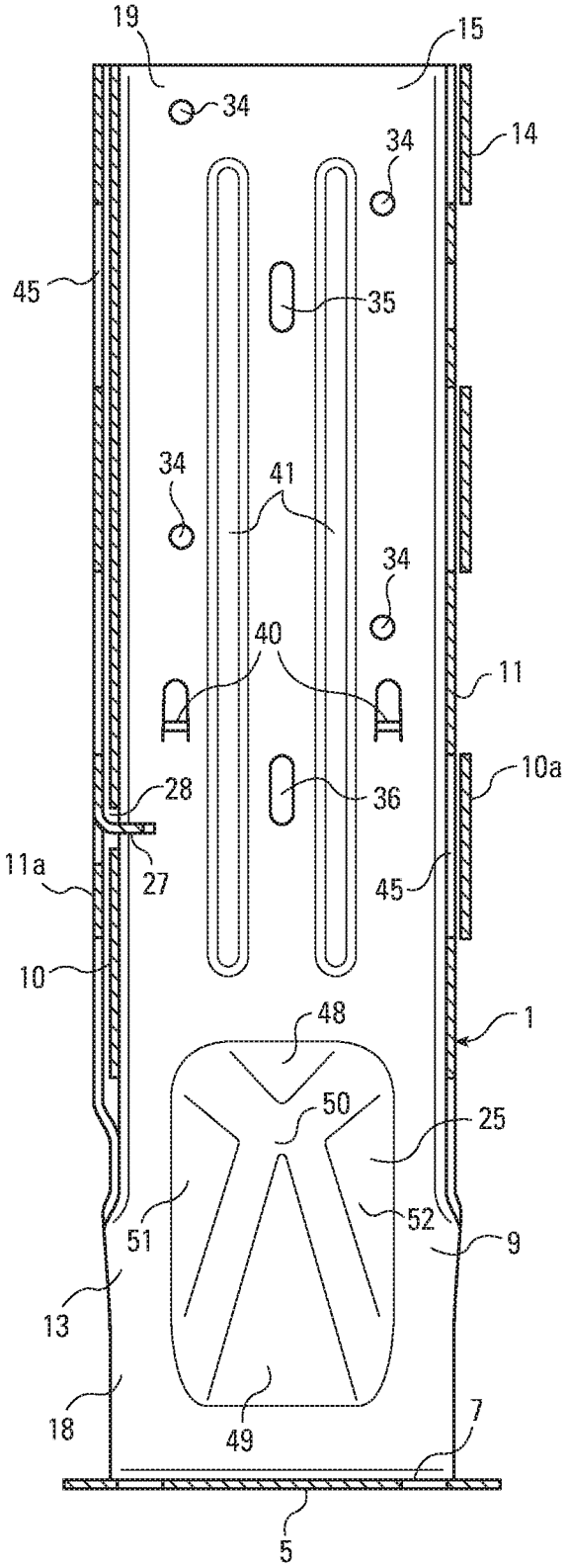
FIG. 9 is a cross-sectional front view of the connector of FIG. 3 taken along the view line shown in FIG. 6.

As shown in FIGS. 1 and 2, greater column strength is achieved by dimensioning the side flange members 10, 10*a*, 11 and 11*a* so that they overlap one with the other. The front and back members 8 and 9 have portions where the front and back members 8 and 9 overlap and overlap the post 4. Thus as shown, for example in FIGS. 6 and 9, first side flange 10 is overlapped by second side flange 11*a* and first side flange 11 is overlapped by second side flange 10*a*. As best shown in FIG. 6, the second side flanges 10*a* and 11*a* that overlie the first side flanges 10 and 11 have steps or offsetting bends 30 so that portions of the second side flanges 10*a* and 11*a* interface with the supported member 4. The offsetting bends are provided where the front and back members 8 and 9 overlap with each other so that the front and back members 8 and 9 where they do not overlap can be in flush contact with the post 4. Together with the first side flanges 10 and 11, second side flanges 10*a* and 11*a* preferably create a close interface between the front and back members 8 and 9 and the sides 21, 22, 23 and 24 of the supported member 3.

Figure 12:
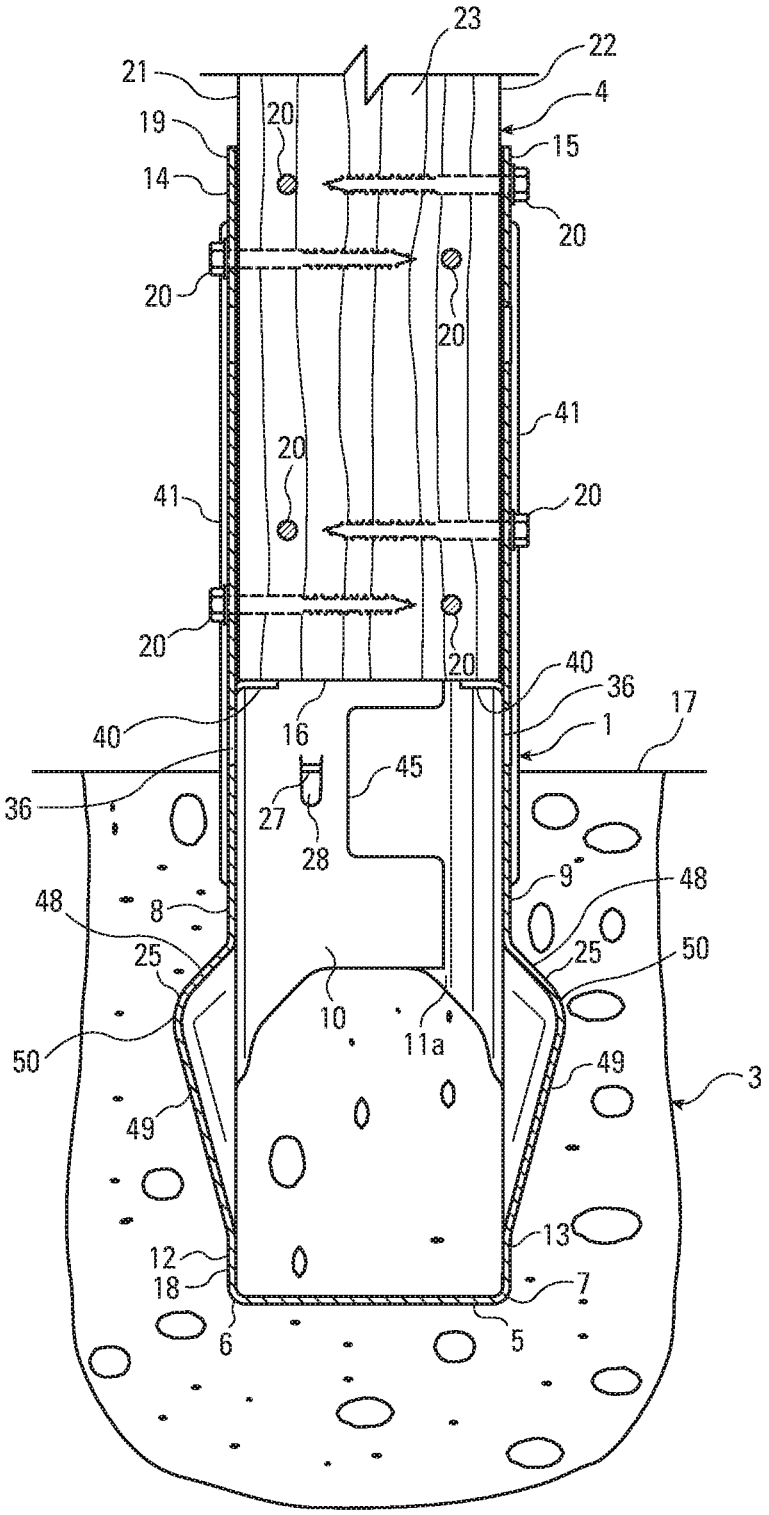
FIG. 12 is a sectional right side view of the connection of FIG. 10 with the section taken through the post and connector as shown in the view line provided in FIG. 11.
Figure 13:
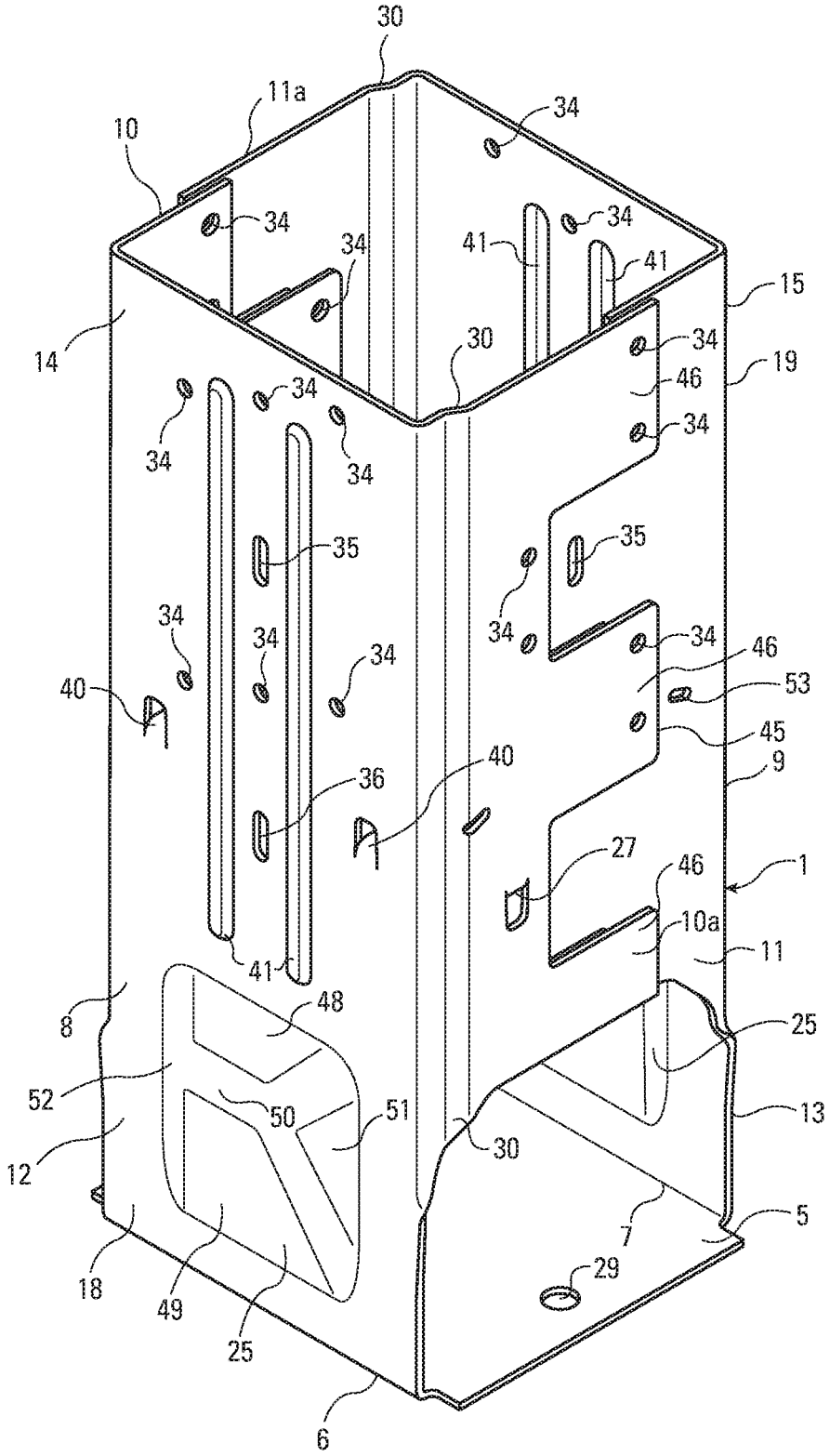
FIG. 13 is a perspective view of a connector of the present invention.
Figure 14:
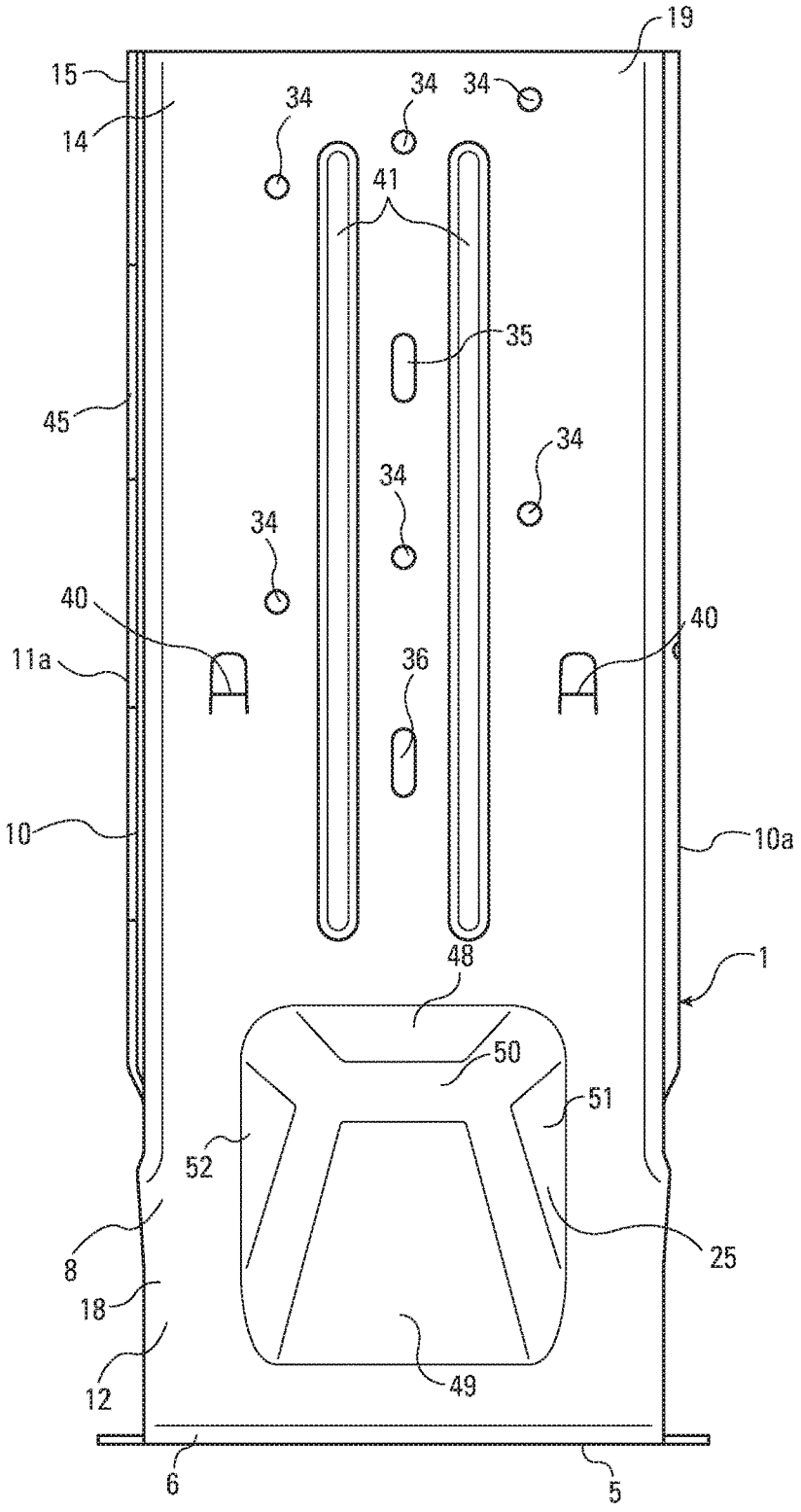
Figure 15:
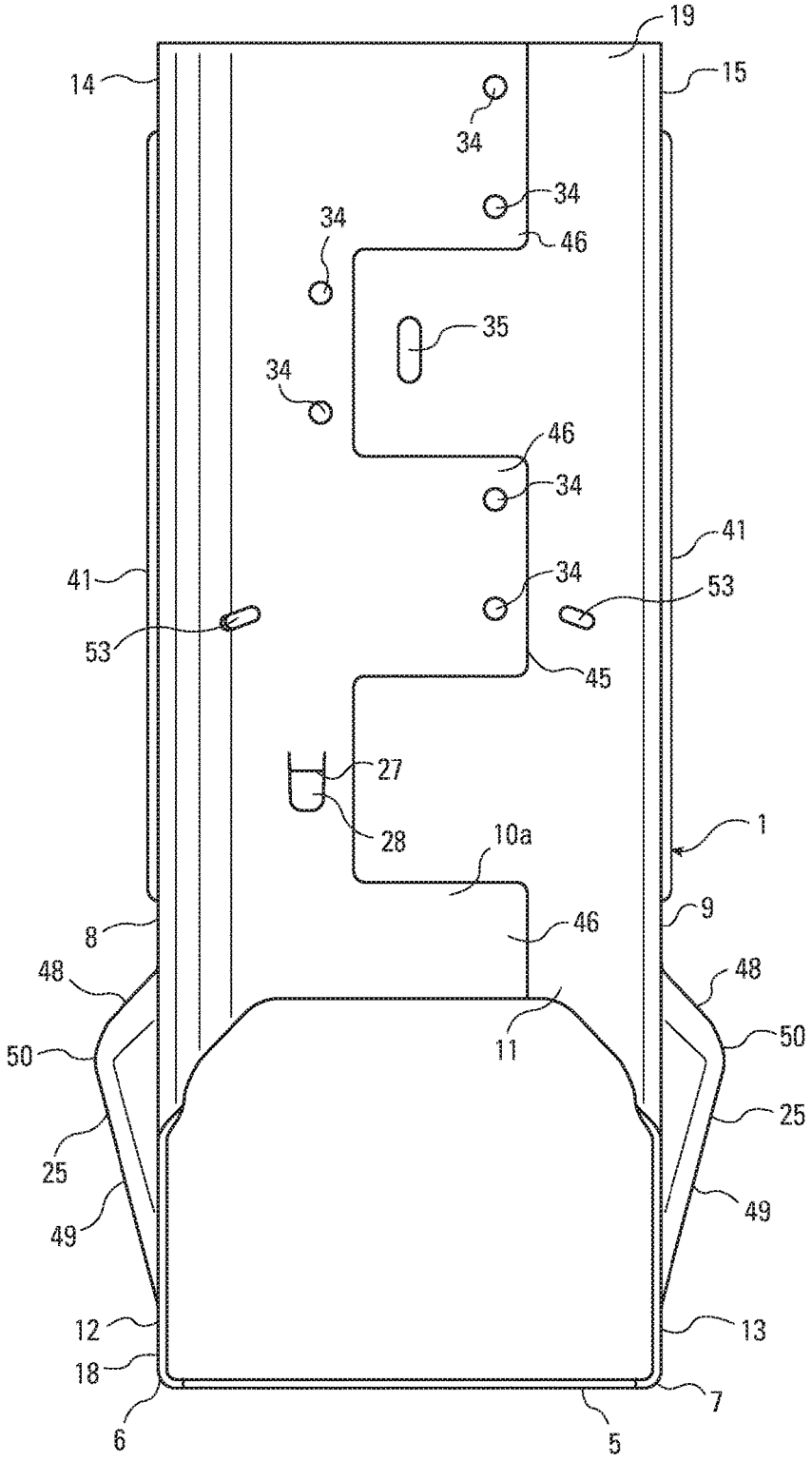
Figure 16:
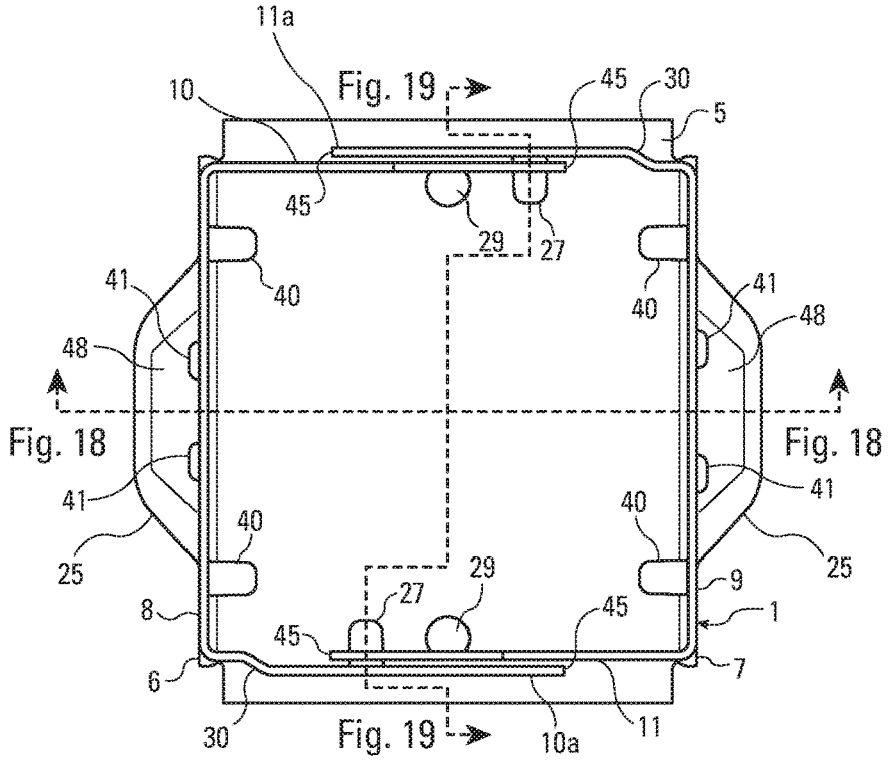
FIG. 16 is a top view of the connector of FIG. 13.
Figure 17:
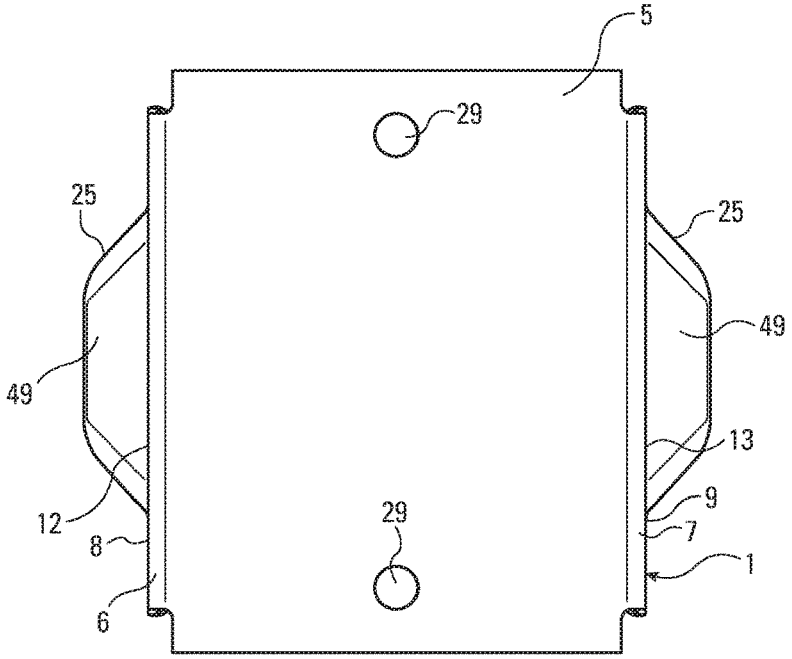
FIG. 17 is a bottom view of the connector of FIG. 13.
Figure 18:
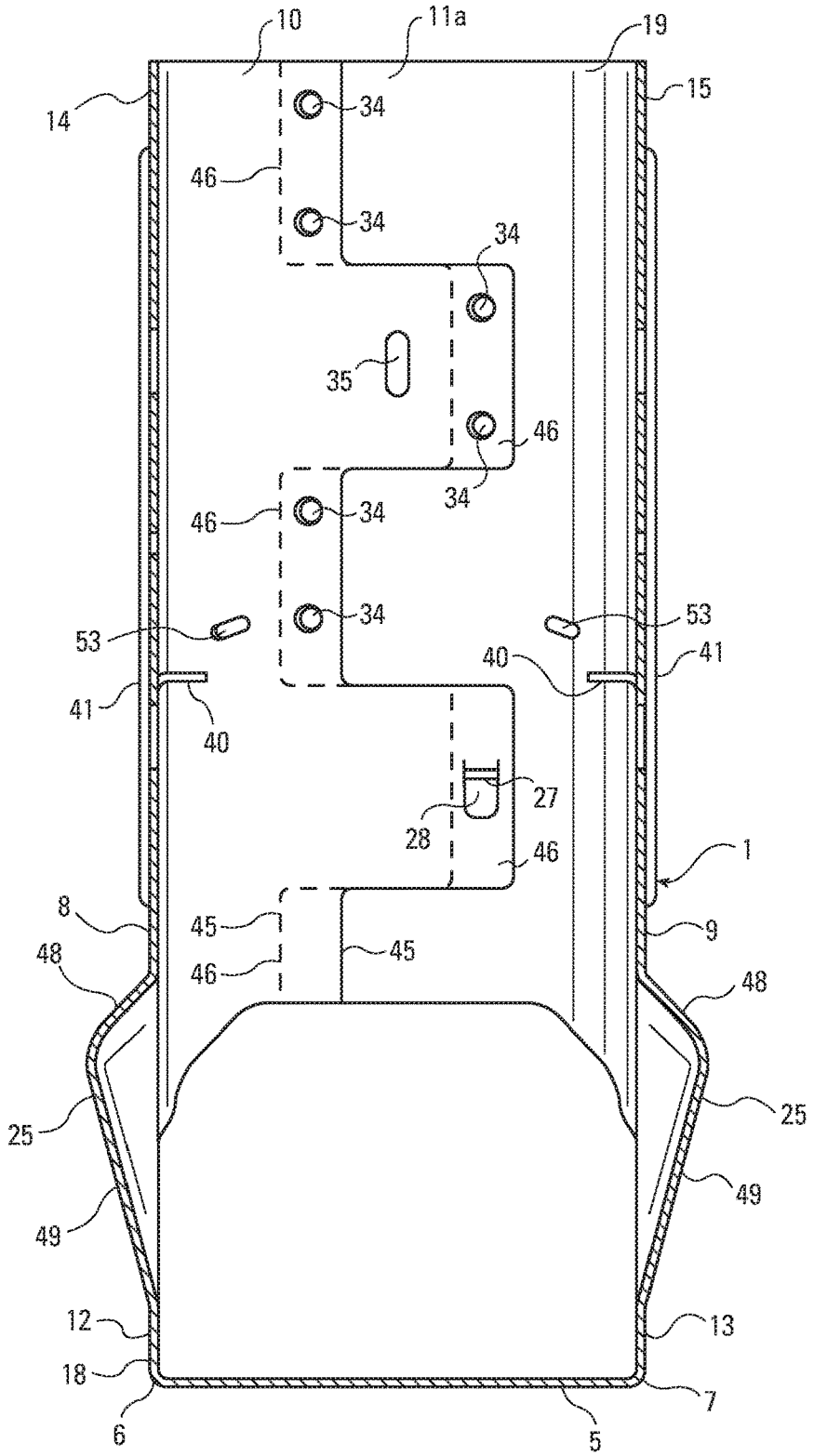
FIG. 18 is a cross-sectional side view of the connector of FIG. 13 with the section taken as shown in the view line of FIG. 16.
Figure 19:
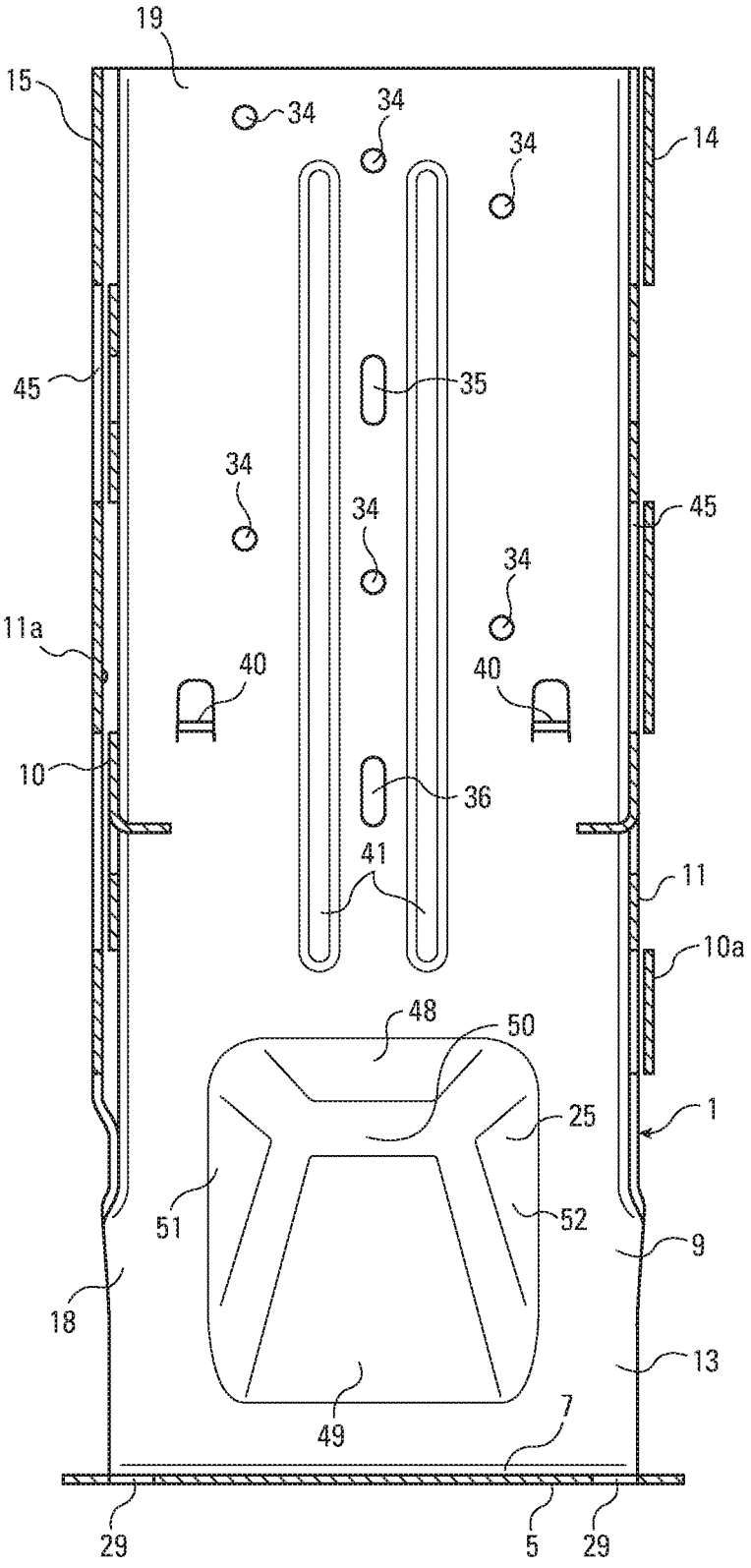
FIG. 19 is a cross-sectional front view of the connector of FIG. 13 with the section taken as shown in the view line of FIG. 16.

As show in FIG. 12, the present invention has front and back members 8 and 9 that together with the base member 5 make the shape of a "U" by bending the blank along the bend lines which are also the front and back edges 6 and 7 of the base member 5. The side flanges 10, 10*a*, 11 and 11*a* project towards and overlap with each other such that front and back members 8 and 9 come together and form a tubular form structure which provides high columnar strength.

To enable post member 4 to be easily attached to the connector with fasteners 20, the front and back members 8 and 9 are formed with fastener openings 34.

As shown in FIG. 1, additional trim attachment openings 35 can be provided in the back members 8 and 9 so that trim members (not shown) can easily be attached to the supported member 3, if the user wants to hide the connector 1.

In using the elevated post base of the present invention, the front and back members 8 and 9 may be either joined together at the factory or in the field. The elevated post base can be installed by forcing it into wet concrete at preselected location to a preselected depth, or it can be attached to members supported by a form and the concrete can be poured around it. As shown in FIGS. 6, 8, 9, 10 and 12, bent tabs 27 are provided at a location whereby the top surface 17 of the cementitious member 3 should be disposed approximately in line with the upper edge of opening 28 and bent tabs 27. When installing the connector 1 in the cementitious member 3, the user should install the connector 1 to a depth where the bent tabs 27 are approximately aligned with the top or upper surface 17 of the cementitious members. Additional openings 36 are provided on the front and back members 8 and 9 that are disposed just above the bent tabs 27. The user can look through these openings 36 to make sure that the top surface 17 of the cementitious member 3 is below these openings 36. Thus opening 36 are used to make sure that the connector 1 is set at the desired depth in the cementitious member 3. Openings 36 are also used as a means for any water below the post 4 to escape from the confines of the connector 1 to prevent water from pooling within the connector 1 and reaching the bottom surface 16 of the post 4. Openings are provided just above the upper surface 17 of the cementitious member. After the concrete hardens, the post 4 is placed on seats 40 which are bent from the front and back members 8 and 9. Seats 40 are preferably tabs bent from the material of the front and back members 8 and 9. Seats 40 are preferably set so that they are approximately 1 inch above the bent tabs 27 that are used to interlock the front and back members, and thus, if installed as directed, the bottom surface 16 of the post should be disposed 1 inch above the upper surface 17 of the cementitious member 3. The upper edge of openings 36 are preferably at the same elevation or just below seats 40.

Preferably, self-drilling and self-tapping threaded fasteners 20 are driven through openings 34 and into the supported member 3.

Figure 4:
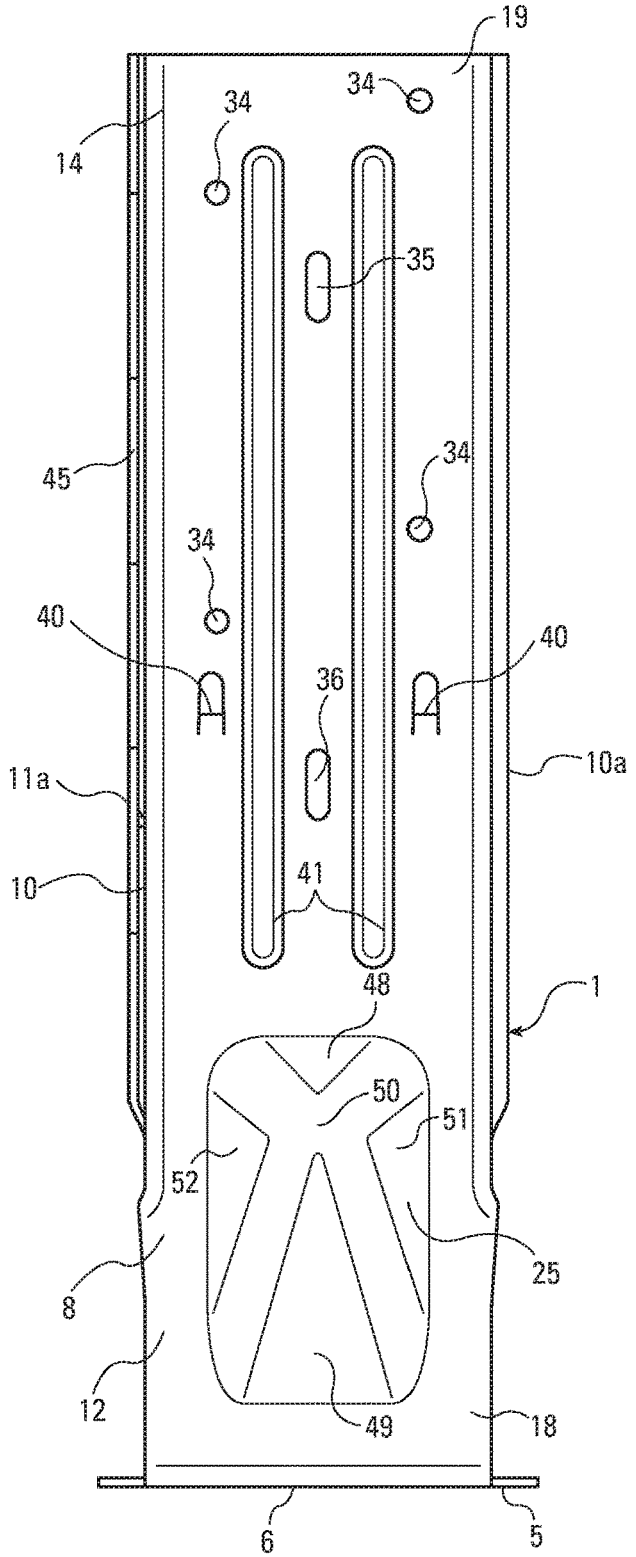

As shown in FIGS. 1, 3 and 4, pairs of stiffening embossments 41 are preferably formed in the front and back members 8 and 9 to further stiffen the front and back members 8 and 9. As shown in FIG. 1, there are preferably two elongated stiffening embossments 41 in each of the front and back members 8 and 9. The two elongated stiffening embossments 41 in each of the font and back members 8 and 9 are parallel to each other and extend from the top of the connector 1 to the lower portion 18 of the connector 1 to just above the protrusions 25 in the embedded portion of the connector 1. The pairs of embossments 41 are provided in the lower portion 18 of the connector 1 and are disposed within the cementitious member 3. The pair of embossments 41 are formed on generally planar surfaces of the front and back members 8 and 9. The pairs of embossments 8 and 9 are formed on the portions of the front and back members 8 and 9 that interface with the opposed side 21 and 22 of the post 4.

To give rigidity and provide columnar strength, the side flanges 10, 10*a*, 11 and 11*a* should be integrally attached to the front and back members 8 and 9 throughout a substantial portion of their length and extend generally toward the other of the front and back member 8 or 9. As discussed above, preferably, the elevated post base 1 is constructed so that the front and back members 8 and 9 have additional second side flanges 10*a* and 11*a*, and the additional side flanges 10*a* and 11*a* overlap with the first side flanges 11 and 10 respectively. Preferably the side flanges 10, 10*a*, 11 and 11*a* are formed with outer edges 45 that have alternating projecting portions 46 creating notches and the notches in one overlapping side flange correspond with the projecting portions 46 in the corresponding overlapping side flange, all while maintaining overlap between corresponding side flanges along their outer edges 45. The fasteners 20 that are driven through side flanges 10,10*a*, 11 and 11*a*, preferably engage the side flanges where they overlap such that any given fastener 20 that engages a side flange passes through two side flanges before entering the post or supported member 4. To give rigidity and provide columnar strength, the side flanges 10, 10*a*, 11 and 11*a* should be attached to the post 4 along a substantial portion of their vertical length. As shown in the figures, at least four fasteners 20 are used that pass through overlapping side flanges 10 and 11A or 11 and 10*a* and enter post 4.

As best shown in FIGS. 5, 6 and 7, the protrusions 25 have upper and lower potions 48 and 49 that angle away from the generally vertical front and back members 8 and 9 and meet at a junction 50 located away from the generally vertically disposed and generally planar surface portions of the front and back members 8 and 9 on which they are formed, thereby forming a wedge that interlocks with the concrete or cementitious member 3 to better resist uplift. As best shown in FIGS. 6 and 7, the protrusions 25 also have angled left and right side potions 51 and 52 that angle away from the generally vertical front and back members 8 and 9 and join with the upper and lower portions 48 and 49. The angled portions 48, 49, 51 and 52 of the protrusions 25 are generally set at obtuse angles to the generally planar front and back members 8 and 9.

As shown in FIG. 1, the back members 8 and 9 are also preferably formed with form attachment openings 53 that are slanted with respect to the generally vertical axis of the connector 1. This slanting of these form attachment openings 53 makes it easier to drive a fastener through the opening 53 and into a form support member when space is tight. Other openings in the connector may also be used to temporarily attach the connector 1 to a concrete form.

We claim:

1. A connection for attaching a post to a cementitious member using a connector, the connection comprising:

a. the post, having a bottom surface;

b. the cementitious member having an upper surface;

c. the connector having a lower portion embedded in the cementitious member and an upper portion receiving the post, the connector including:

1. a base member connecting a front member and an opposed back member with the base member being disposed in the cementitious member and with the bottom surface of the post being spaced apart from the base member and with material of the cementitious member disposed within the lower portion of the connector between the bottom surface of the post and the base member;

2. the front member being connected to the base member, the front member extending upwardly from the base member so as to extend out of the upper surface of the cementitious member, the front member having one or more side flanges extending angularly toward the opposed back member and overlapping with portions of the back member where the connector receives the post;

3. the opposed back member being connected to the base member, the opposed back member extending upwardly from the base member so as to extend out of the upper surface of the cementitious member, the back member having one or more side flanges extending angularly toward the opposed front member and overlapping with portions of the front member where the connector receives the post such that together with the front member, the back member and the front member encapsulate at least a portion of the post; and d. one or more fasteners connecting the post to the connector so that the post, the connector and the cementitious member will resist movement as a unit.

2. The connection of claim 1, wherein:

the base member has a front edge and an opposed back edge with the front member being connected to the front edge of the base member and the opposed back member being connected to the back edge of the base member.

3. The connection of claim 1, wherein:

one or more of the one or more fasteners connecting the post to the connector pass through the portions where the front and back members overlap such that the one or more of the one or more fastener pass through both the front and back members and into the post.

4. The connection of claim 1, wherein:

each of the front and back members has an offsetting bend where the overlap with the other of the front and back member occurs so that the front and back members where they do not overlap can be in flush contact with the post.

5. The connection of claim 1, wherein:

the one or more side flanges of the front member extending angularly toward the opposed back member and overlapping with portions of the back member, and the one or more side flanges of the back member extending angularly toward the opposed front member and overlapping with portions of the front member overlap along most the length of the portion of the post that is received in the connector.

6. The connection of claim 1, wherein:

the one or more side flanges extending angularly toward the opposed back member and overlapping with portions of the back member is mechanically interlocked with the back member at the overlap, and the one or more side flanges extending angularly toward the opposed front member and overlapping with portions of the front member is mechanically interlocked with the front member at the overlap.

7. The connection of claim 6, wherein:

each of the front and back members is formed with a bent tab that interlocks with a corresponding opening on the other of the front or back member to hold the front and back members in fixed relation.

8. The connection of claim 1, wherein:

the front and back members are formed with lower portions that are embedded in the cementitious member and the lower portions are formed with one or more protrusions that extend outwardly from the front and back members and away from the connector.

9. The connection of claim 8, wherein:

the lower portions of the front and back members are formed with generally planar portions surrounding the protrusions and the protrusions have upper and lower potions that angle away from the generally planar portions of the front and back members and meet at a juncture located away from the generally planar portions of the front and back members.

10. The connection of claim 9, wherein:

one or more openings are provided in the one or more protrusions.

11. The connection of claim 10, wherein:

the one or more openings are provided in the upper portion of the protrusion.

12. The connection of claim 11, wherein:

only one opening is provided in the upper portion of each of the one or more protrusions and only one protrusion is provided in each of the front and back members.

13. The connection of claim 1, wherein:

a. one or more tabs are formed from the front and back members that align with the upper surface of the cementitious member, and b. the front and back members are provided with one or more openings that are disposed just above the tabs that align with the upper surface of the cementitious member.

14. The connection of claim 1, wherein:

the post rests on one or more seats and the one or more seats are formed from the front and back members of the connector.

15. The connection of claim 1, wherein:

the front and back members having lower portions embedded in the cementitious member, and the lower portions are formed with one or more stiffening embossments.

16. The connection of claim 15, wherein:

there are preferably two stiffening embossments in each of the front and back members that are elongated, the two elongated stiffening embossments in each of the font and back members are parallel to each other and extend from the top of the connector to the lower portions of the front and back members.

17. The connection of claim 1, wherein:

the one or more side flanges of the front and back members are integrally attached to the front and back members throughout a substantial portion of their length.

18. The connection of claim 1, wherein:

the one or more side flanges of the front and back members are formed with outer edges that have alternating projecting portions and notches where the overlap with the other of the front and back member occurs and the notches in one of the front and back members correspond with the projecting portions in the other of the front and back members.

19. The connection of claim 1, wherein:

one or more openings are provided in the connector that are disposed just above the upper surface of the cementitious member.

20. The connection of claim 1, wherein:

the one or more fasteners connecting the post to the connector are threaded fasteners.

* * * * *